US012540751B1

(12) United States Patent
Loutz et al.

(10) Patent No.: US 12,540,751 B1
(45) Date of Patent: Feb. 3, 2026

(54) AIR VENT DEFLECTOR

(71) Applicant: YOBL Digital Marketing Inc., Madison, WI (US)

(72) Inventors: Omri Loutz, Ashkelon (IL); Yuval Bar-Hai, Ashkelon (IL)

(73) Assignee: YOBL DIGITAL MARKETING INC., Madison, WI (US)

( * ) Notice: Subject to any disclaimer, the term of this patent is extended or adjusted under 35 U.S.C. 154(b) by 0 days.

(21) Appl. No.: 19/285,401

(22) Filed: Jul. 30, 2025

(51) Int. Cl.
*F24F 13/08* (2006.01)

(52) U.S. Cl.
CPC ..... *F24F 13/081* (2013.01)

(58) Field of Classification Search
CPC ..... F24F 13/081
USPC ..... 454/284
See application file for complete search history.

(56) References Cited

U.S. PATENT DOCUMENTS 1,622,031 A * 3/1927 Elters ..... F24F 13/00 454/307
2,161,001 A * 6/1939 Bedol ..... E06B 7/02 454/307
3,225,679 A * 12/1965 Meyer ..... F24F 13/08 454/307
3,358,578 A * 12/1967 Meyer ..... F24F 13/08 454/307
3,768,235 A * 10/1973 Meyer ..... B01D 46/12 160/228
5,232,403 A * 8/1993 Marotta ..... F24F 13/081 454/307
6,929,542 B1 * 8/2005 Stravitz ..... F24F 13/06 454/307
11,703,250 B1 7/2023 Mosiman et al.
12,000,616 B1 6/2024 Mosiman et al.

* cited by examiner

*Primary Examiner* — Steven B McAllister
*Assistant Examiner* — Dana K Tighe
(74) *Attorney, Agent, or Firm* — SLEMAN & LUND LLP

(57) ABSTRACT

In some examples, an adjustable air deflector includes a first portion having a first sidewall and a first curved backwall, a second portion having a second sidewall and a second curved backwall; and at least one enclosure configured to receive a magnet, the at least one enclosure including a receptacle integrated with one of the first portion and the second portion, and a holder configured to fit within the receptacle, the holder including an outer wall, two sidewalls, a top wall, and a bottom wall, the sidewalls, top wall, and bottom wall of the holder collectively defining a cavity shaped to receive the magnet, wherein the first portion and second portion are telescopically translatable relative to one another to vary a length of the air deflector.

9 Claims, 27 Drawing Sheets

AIR VENT DEFLECTOR

FIELD OF THE DISCLOSURE

Figure 1:
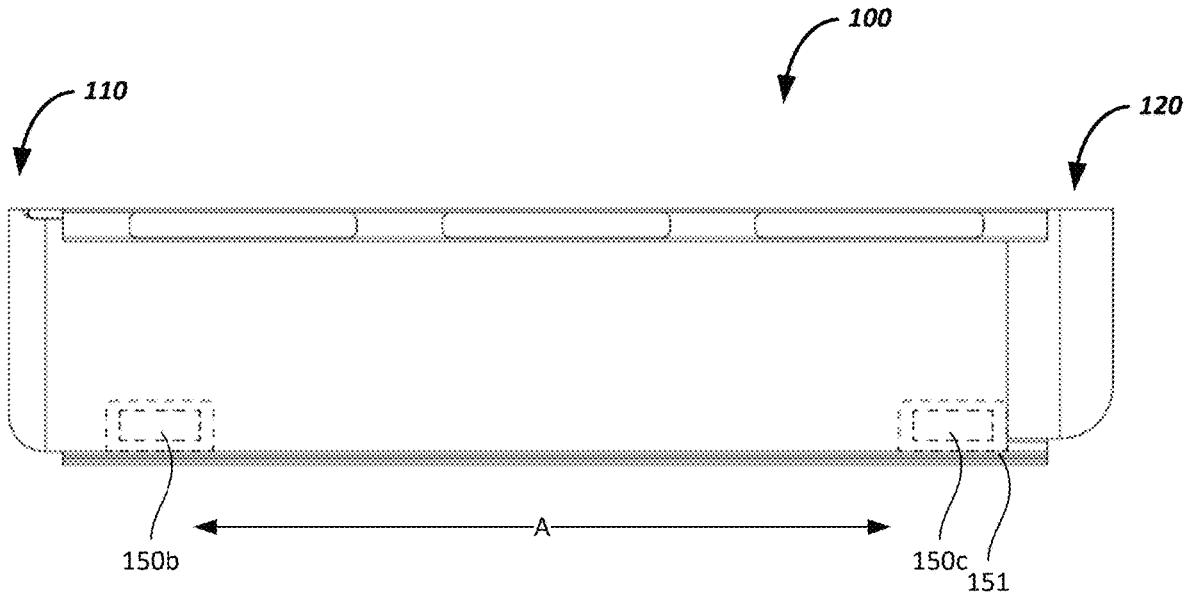
Figure 2:
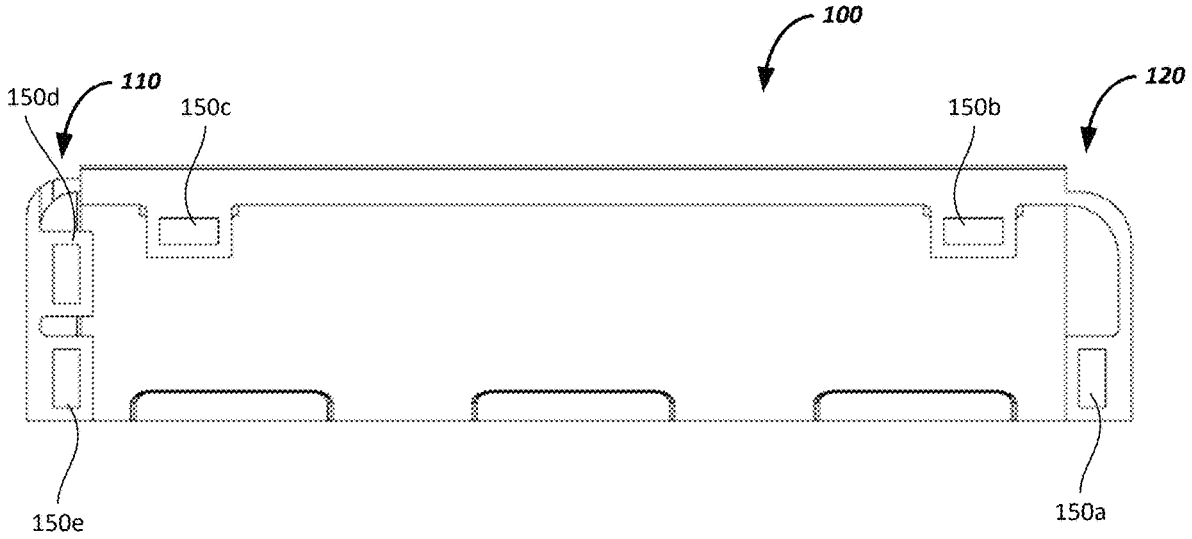
Figure 3:
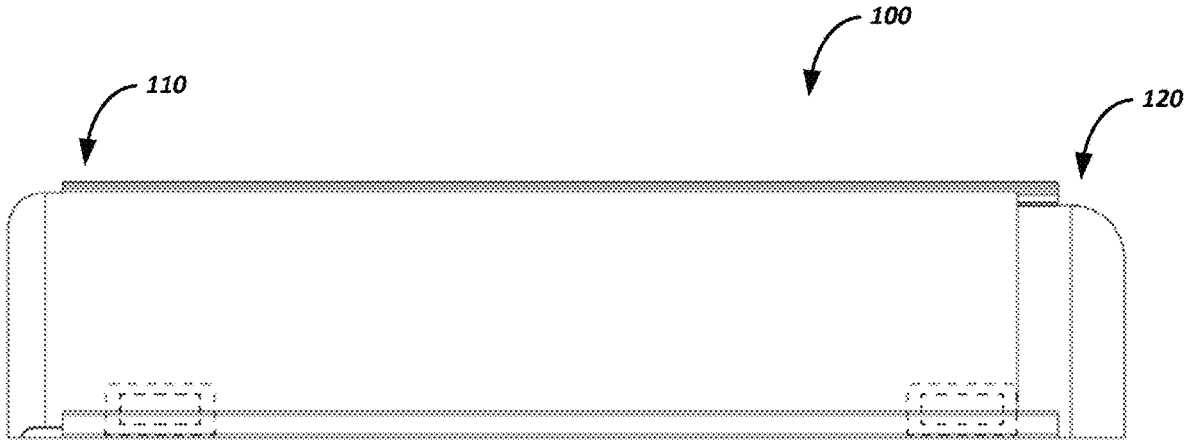
Figure 4:
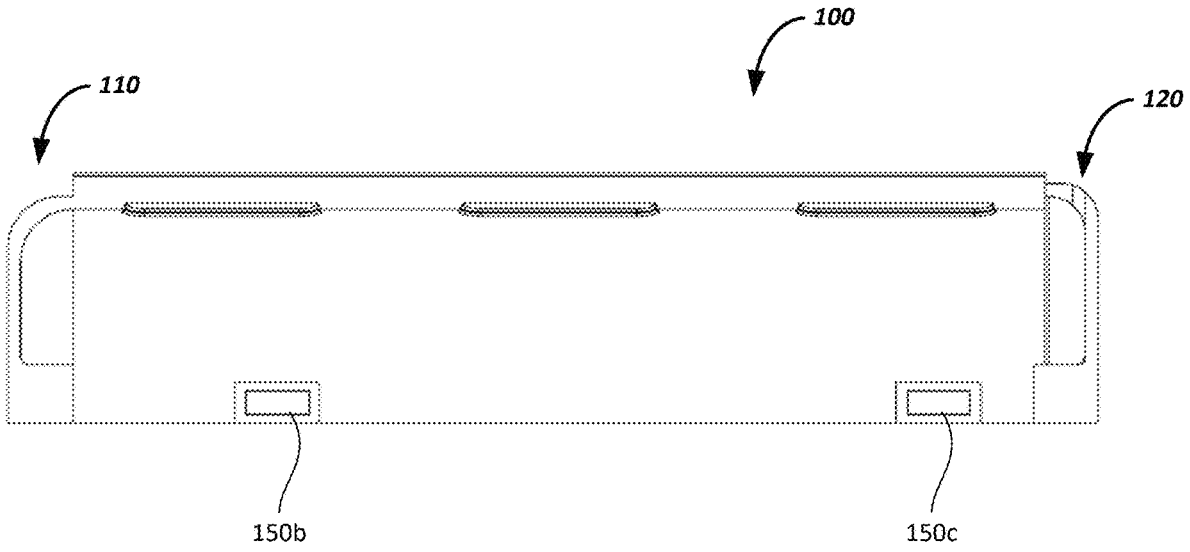

The present disclosure relates generally to improvements for heating, ventilation, and air conditioning (HVAC) systems, and more specifically, to devices and methods for deflecting air from an air vent.

BACKGROUND OF THE DISCLOSURE

Air vents are integral components of heating, ventilation, and air conditioning (HVAC) systems, designed to regulate and distribute conditioned air. Air vents typically are dual-purpose and useful for providing warm air during the winter months and cool air during the hotter summer months. Such air vents are common in both commercial and residential applications and are typically installed in floors, walls, or ceilings. The air vents may vary in size, shape, and directional capability depending on the building's layout and the system's design. The most common air vents only provide the ability to open and close the vent according the user's needs. Proper airflow through these vents ensures even temperature distribution, prevents hot or cold spots, and supports effective circulation of clean air.

In some instances, airflow may be compromised by the environment and/or layout of a room. For example, furniture (e.g., couches, bookcases, etc.) may block or impede an air vent and with it the flow of air coming out of the air vent. This can result in a room becoming too cold or too hot compared to others in the system. Additionally, blocked air vents may result in increased costs for the user. Moving the air vent to a different position is typically cost prohibitive as it requires the movement of not just the air vent and its associated duct system, but also the closing of the original cavity. Thus, it would be beneficial to continue to improve upon devices and methods that allow for the redirection of air coming out of an air vent.

SUMMARY OF THE DISCLOSURE

In some examples, an adjustable air deflector includes a first portion having a first sidewall and a first curved backwall, a second portion having a second sidewall and a second curved backwall; and at least one enclosure configured to receive a magnet, the at least one enclosure including a receptacle integrated with one of the first portion and the second portion, and a holder configured to fit within the receptacle, the holder including an outer wall, two sidewalls, a top wall, and a bottom wall, the sidewalls, top wall, and bottom wall of the holder collectively defining a cavity shaped to receive the magnet, wherein the first portion and second portion are telescopically translatable relative to one another to vary a length of the air deflector.

In some examples, an adjustable air deflector includes a first portion having opposing sidewalls, a backwall having a plurality of magnets, and an upper surface, the opposing sidewalls each including a mating element for mating with at least one other extension portion, and at least one enclosure configured to receive a magnet, the at least one enclosure including a receptacle integrated with one of the first portion and the second portion, and a holder configured to fit within the receptacle, the holder including an outer wall, two sidewalls, a top wall, and a bottom wall, the sidewalls, top wall, and bottom wall of the holder collectively defining a cavity shaped to receive the magnet.

BRIEF DESCRIPTION OF THE DISCLOSURE

Various embodiments of the presently disclosed structures and methods are described herein with reference to the drawings, wherein:

FIGS. 1-11 illustrate a first embodiment of a vent deflector according to the disclosure; and FIGS. 12-25 illustrate a second embodiment of a vent deflector according to the disclosure; and FIG. 26A-27E illustrate one embodiment of an enclosure for holding a magnet.

Various embodiments of the present invention will now be described with reference to the appended drawings. It is to be appreciated that these drawings depict only some embodiments of the invention and are therefore not to be considered limiting of its scope.

DETAILED DESCRIPTION

Despite the various improvements that have been made to air vents, conventional devices and methods suffer from certain shortcomings as described above.

There therefore is a need for further improvements to the devices, systems, and methods of deflecting air from air vents. Among other advantages, the present disclosure may address one or more of these needs.

Figure 5:
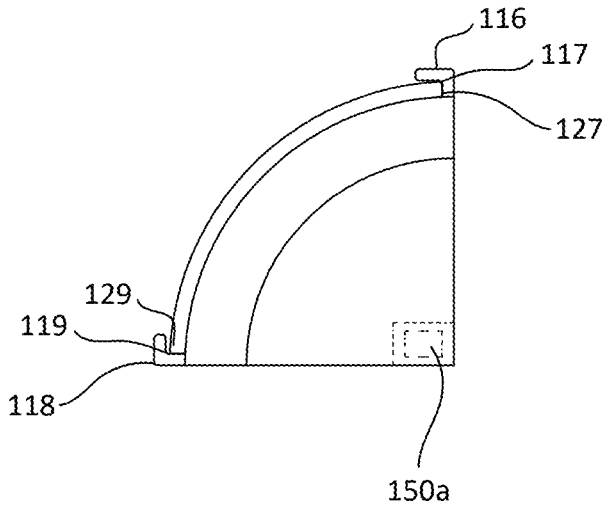
Figure 6:
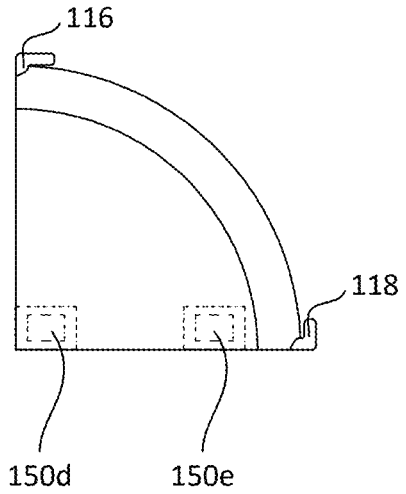
Figure 7:
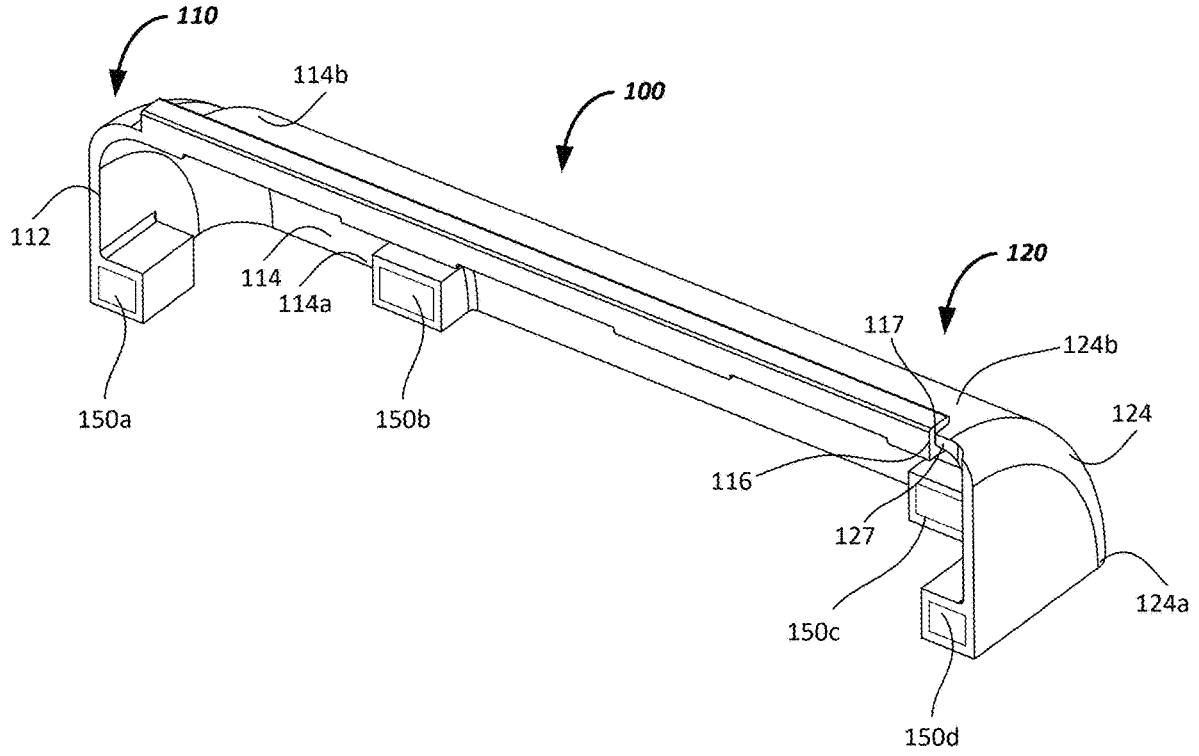
Figure 8:
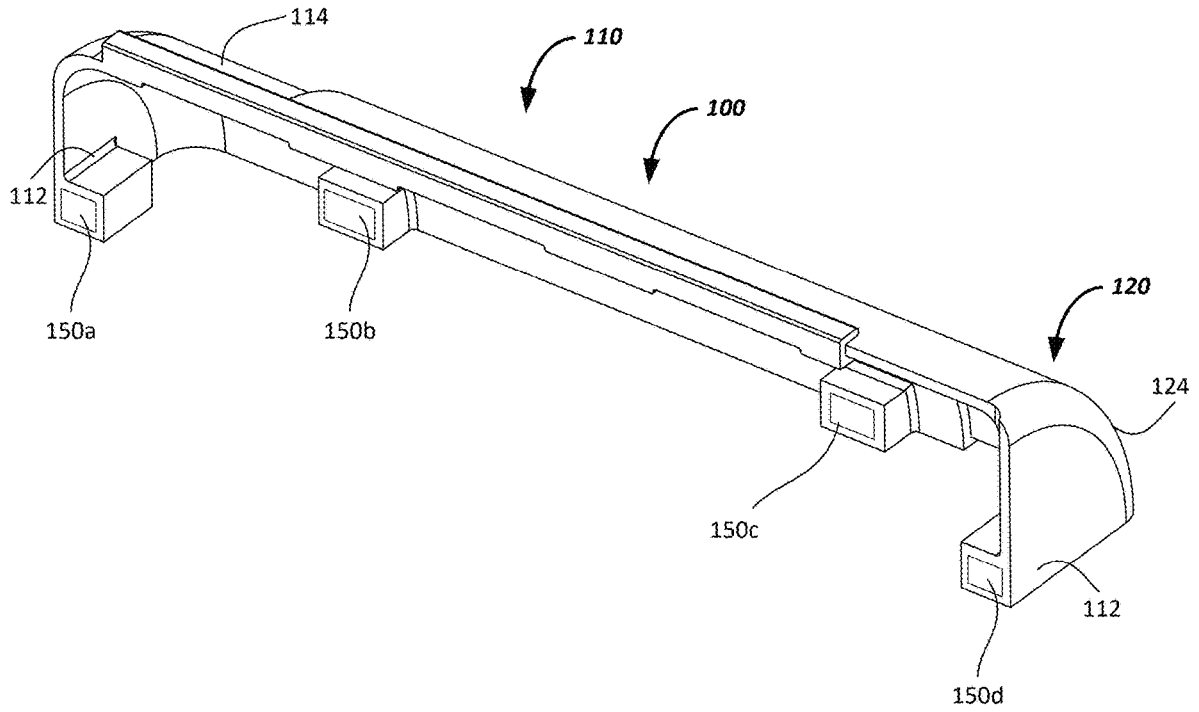
Figure 9:
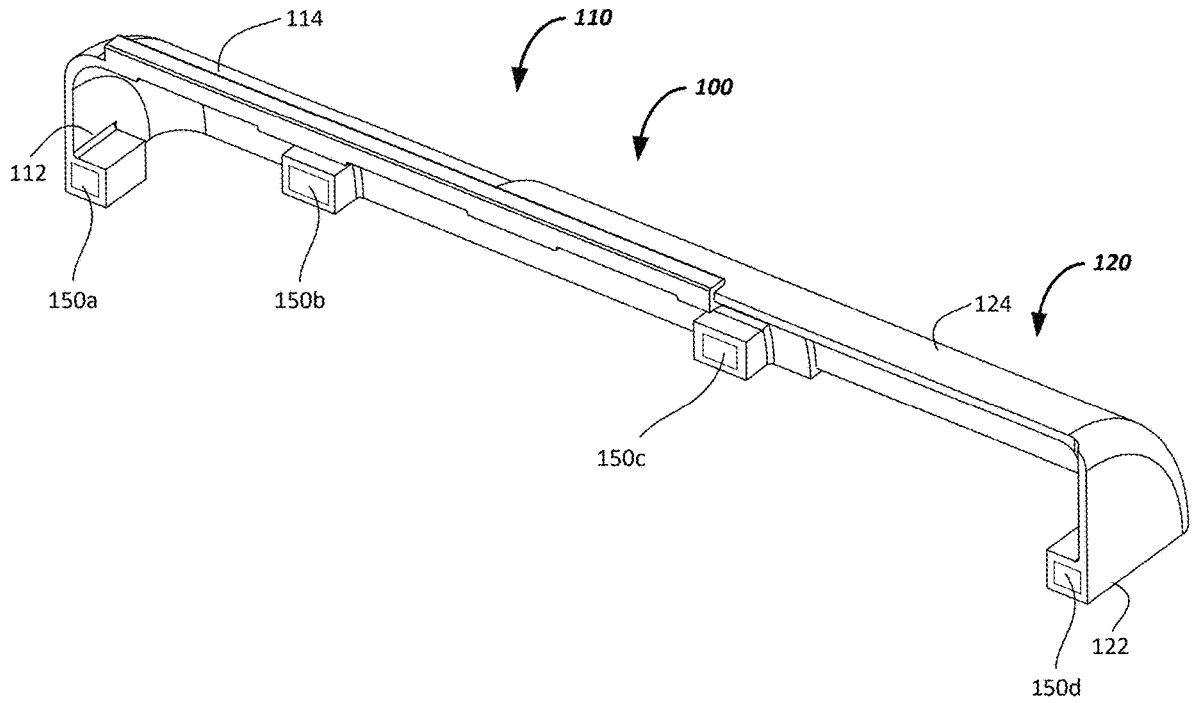
Figure 10:
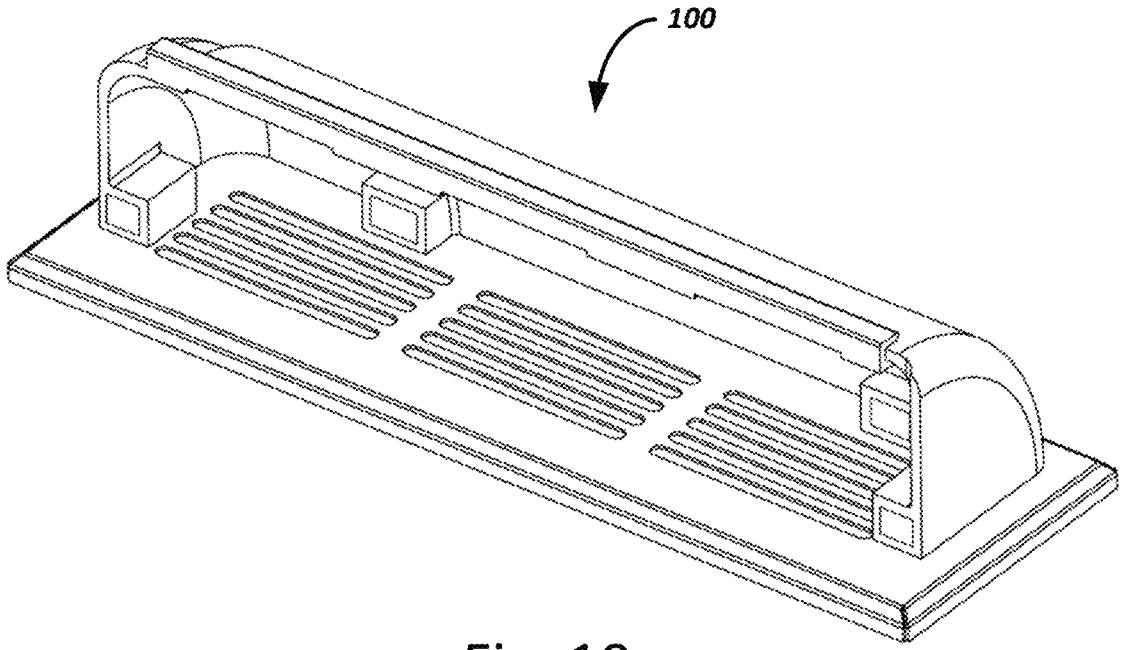
Figure 11:
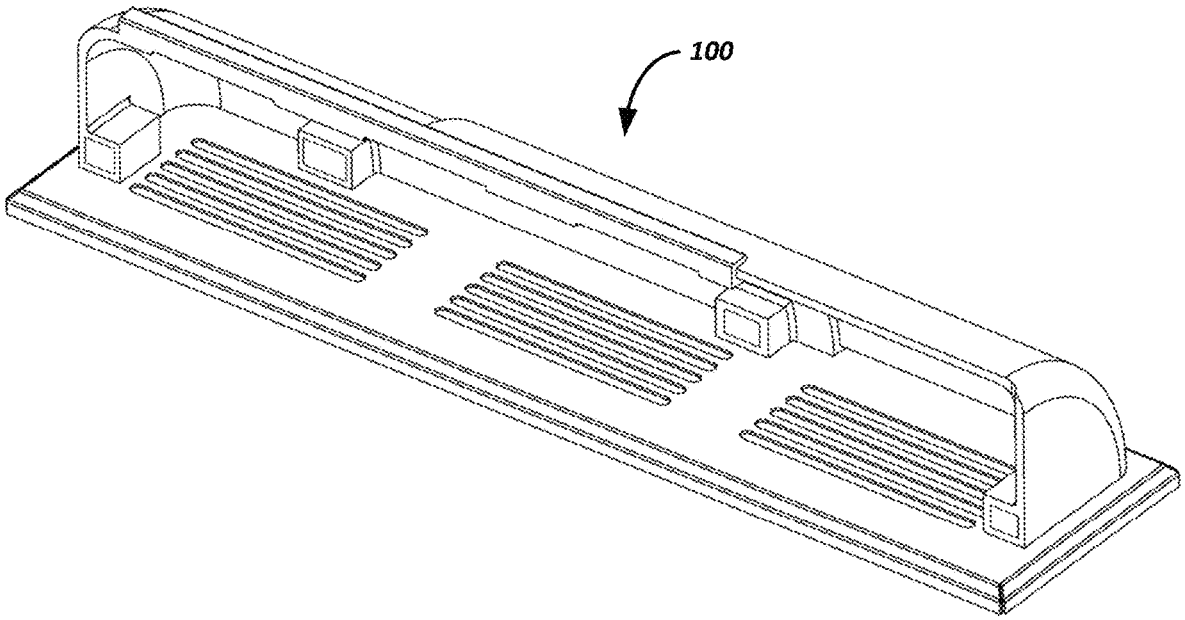
Figure 12:
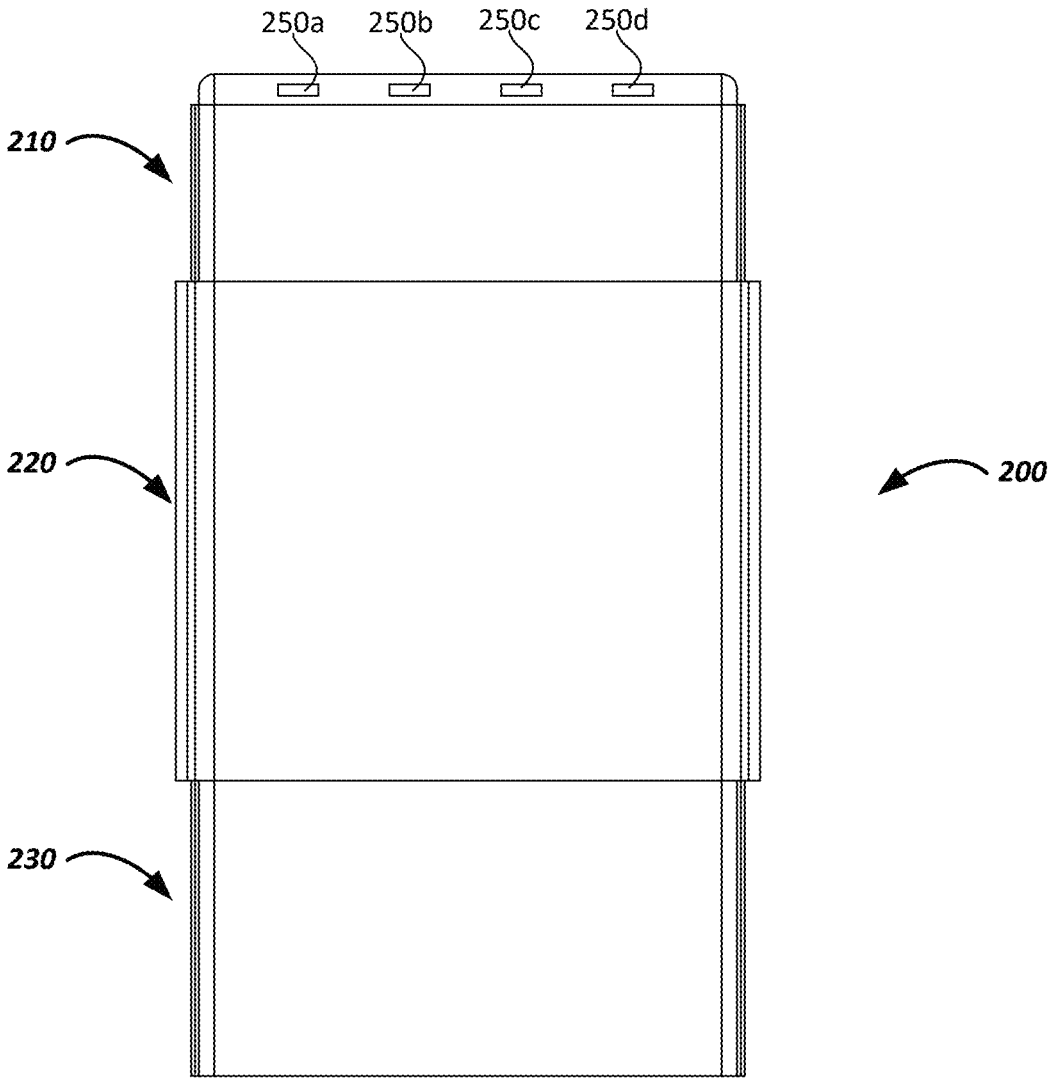
Figure 13:
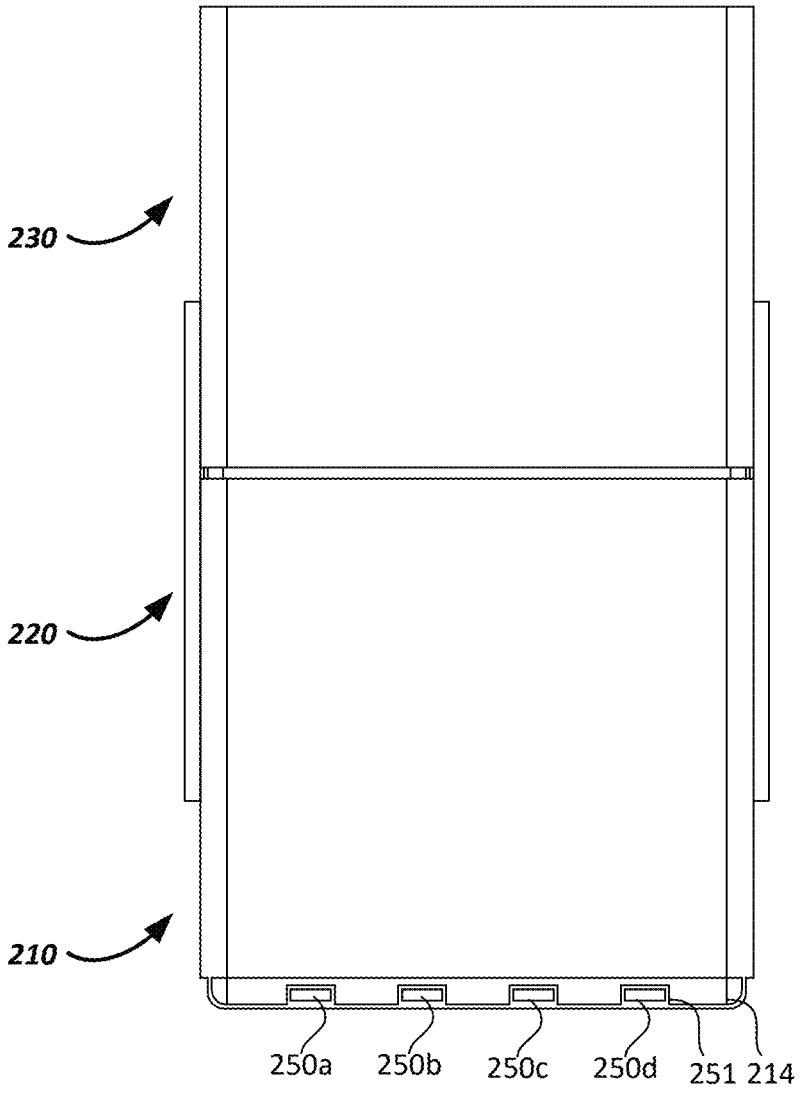
Figure 14:
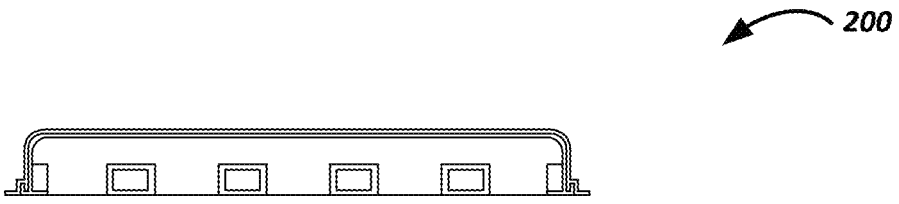
Figure 15:
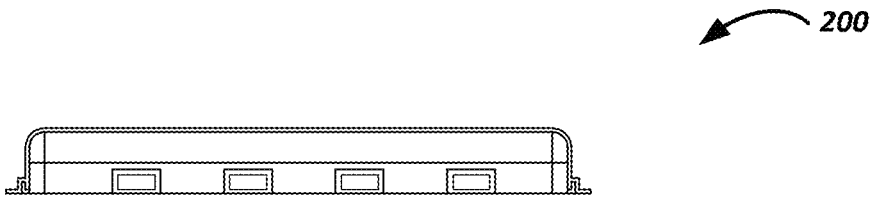
Figure 16:
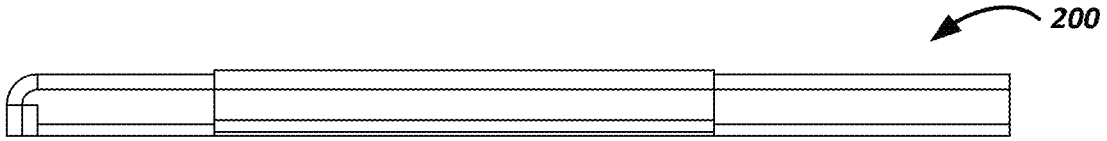
Figure 17:
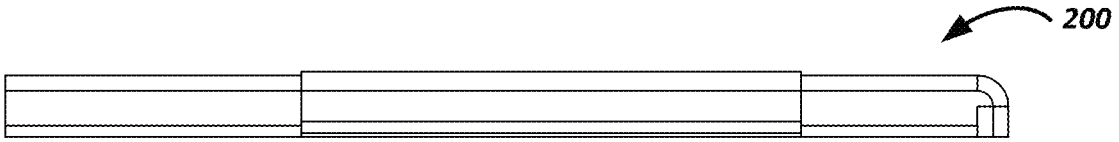

FIGS. 1-11 illustrate a first embodiment of an air deflector 100. Air deflector 100 may be formed of a durable plastic, metal, wood or other components and may be generally formed of two portions, including a first portion 110 and a second portion 120. In some examples, the material of the air deflector 100 may be transparent. First portion 110 and second portion 120 may be translatable relative to one another in the direction of arrow "A". First portion 110 may include an arc-shaped first sidewall 112 and a curved backwall 114. As best seen in FIGS. 6-9, curved backwall 114 may begin at the lower edge of first portion 110 and form a curved surface over an angle of 90 degrees so as to form a canopy that transitions from a back surface 114*a* to an upper surface 114*b* of the first portion. Similarly, second portion 120 may include an opposing arch-shaped second sidewall 122 and a curved backwall 124. Curved backwall 124 may begin at the lower edge of second portion 120 and form a curved surface over an angle of 90 degrees so as to form a canopy that transitions from a back surface 124*a* to an upper surface 124*b* of the second portion. With reference to FIGS. 5-7, first portion 110 may further include an upper projection 116 that defines a channel 117 sized to receive a portion of the second portion. Specifically, second portion 120 may include an upper lip 127 that is sized to be fit within channel 117 and to translate relative thereto. First and second portions 110,120 may also be coupled at the bottom edges of the curved backwalls 114,124. Specifically, first backwall 114 may define a lower projection 118 that forms a channel 119, and second backwall 124 may have a lower lip 129 that is sized to fit within channel 119 and to be translatable relative thereto. As shown in Figs. X1,X2, first portion 110 and second portion 120 may translate relative to one another so that backwalls 114,124 overlap by a predetermined amount so to adjust the length of the air deflector to accommodate various sizes. For example, in the smallest configuration, backwalls 114,124 may overlap by 80%, 90%, 95% or 100%, and in the largest (i.e., longest) configuration, backwalls 114, 124 may overlap by 60%, 50%, 40%, 30%, 20%, 10% or 5%. Thus, a user may pull first and second portions 110,120 apart or push them together to create a greater overall until the overall length of air deflector 100 is suitable for its intended use. In some examples, vent deflector 100 may measure 3.5 inches in width, 2.6 inches in height, and may have a length adjustable between 9.2 inches and 16 inches in length, fitting vents on ceilings, floors, and walls. They ensure effective air redirection for various vent sizes.

Air deflector 100 may further include a number of magnets to couple them to a magnetic air vent. Air deflector 100 is shown to include five magnets 150*a*-150*e* disposed within enclosures 151, but it will be understood that the number of magnets may vary. In the example shown, first portion 110 may include a first magnet 150*a* on first sidewall 112, and two magnets 150*b*, 150*c* disposed on the first backwall 114 along the bottom edge. Second portion 120 may include two magnets 150*d*, 150*e* disposed on the second sidewall 122. In some examples, the magnets include five neodymium magnets, ensuring a strong grip on walls and ceilings so that the vent deflector does not fall off the vent and provides peace of mind even with cleaning robots or accidental bumps. When air deflector 100 is to be utilized with a non-magnetic air vent, secondary magnets may be adhered (e.g., glued, etc.) onto the air vent at corresponding locations on the air vent so that magnets 150*a*-150*e* are attracted thereto to couple the air deflector to the air vent. Alternatively, double-sided stickers may couple the bottom of air deflector 100 to an air vent. Thus, the installation process requires no tools as the user may simply adjust the length of the air deflector to a particular size, and places it on the vent for coupling by magnets. For non-magnetic surfaces like wood or aluminum, stickers or secondary magnets may be used to aid in the coupling of the two components.

Figure 18:
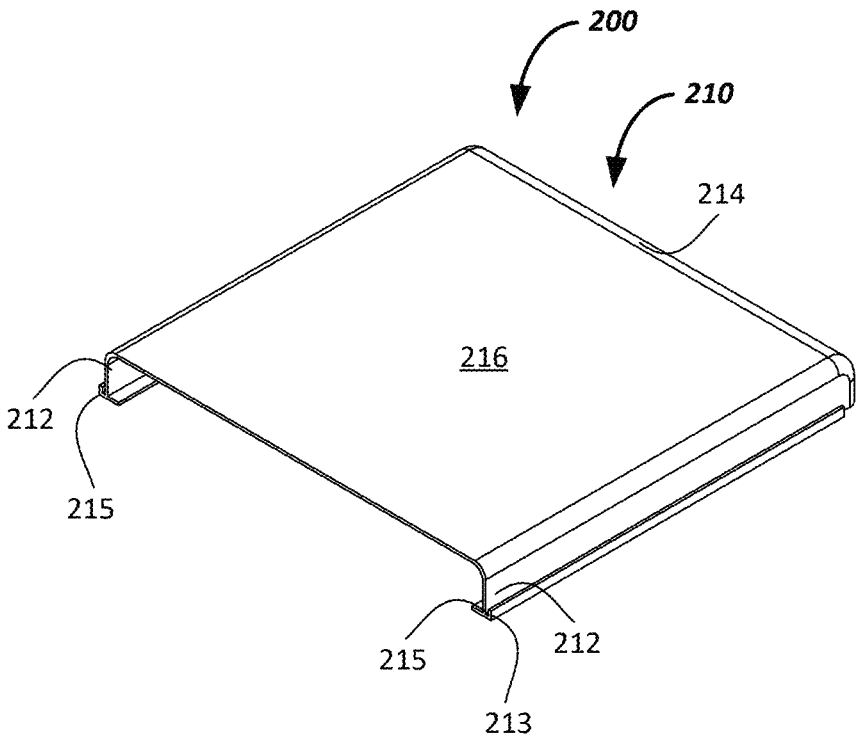
Figure 19:
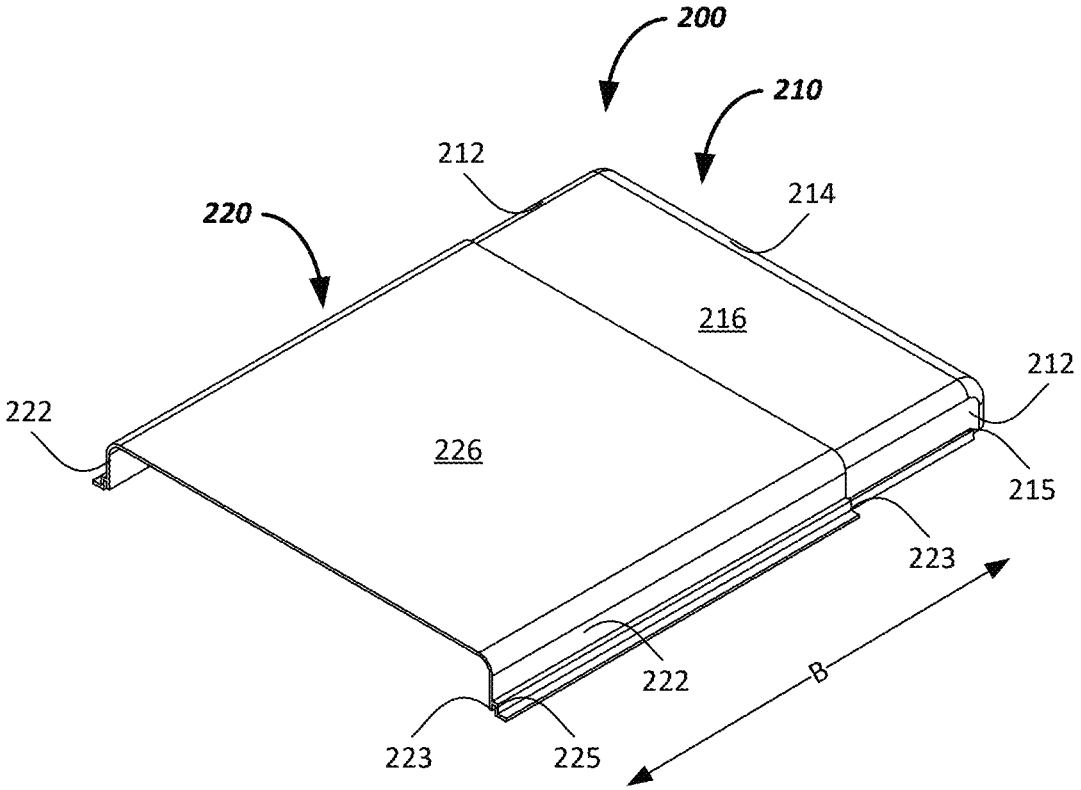
Figure 20:
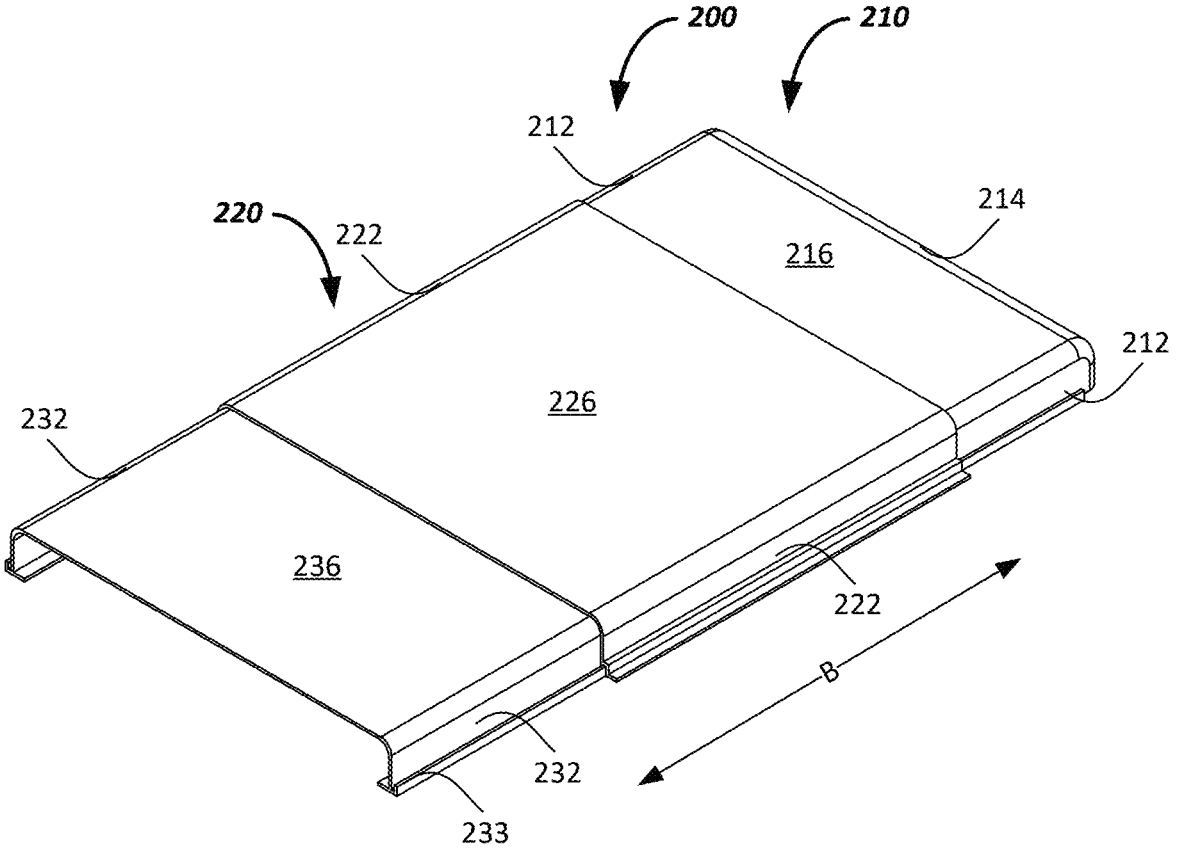
Figure 21:
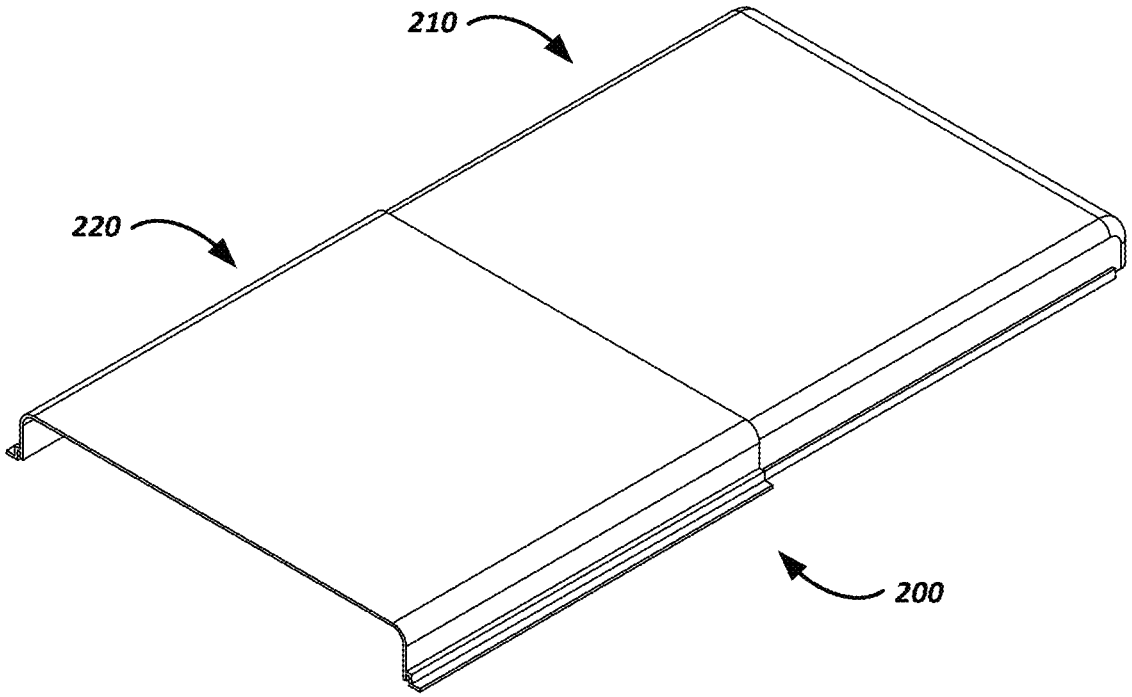
Figure 22:
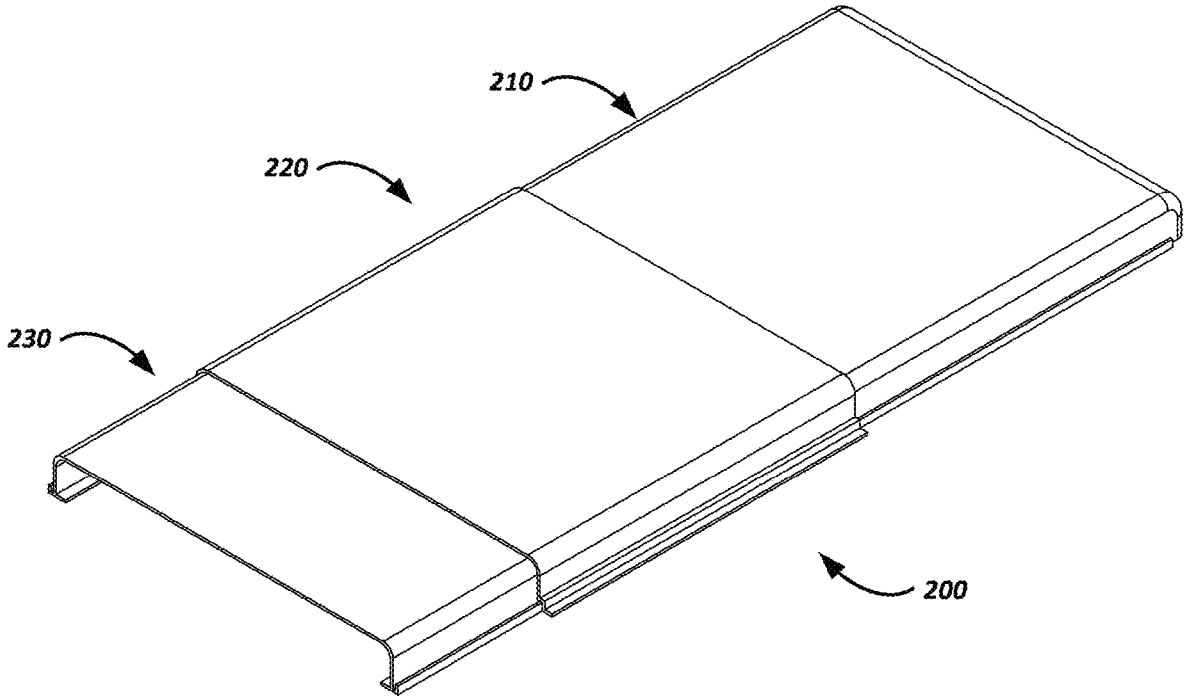
Figure 23:
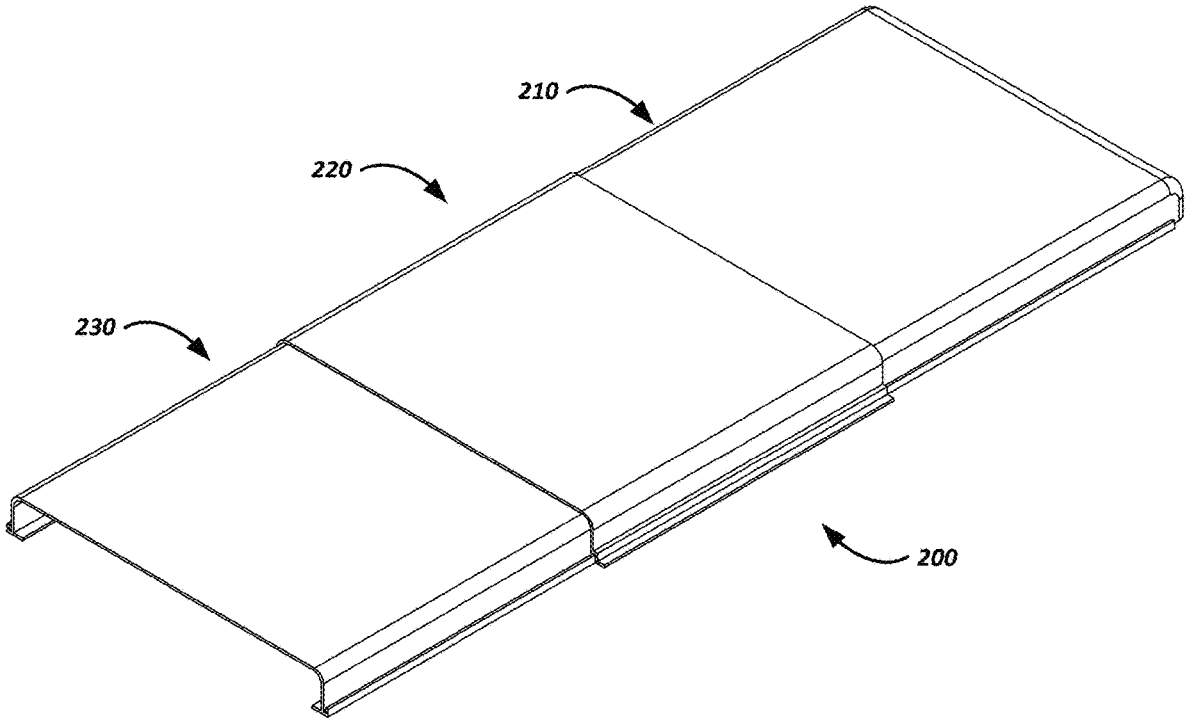
Figure 24:
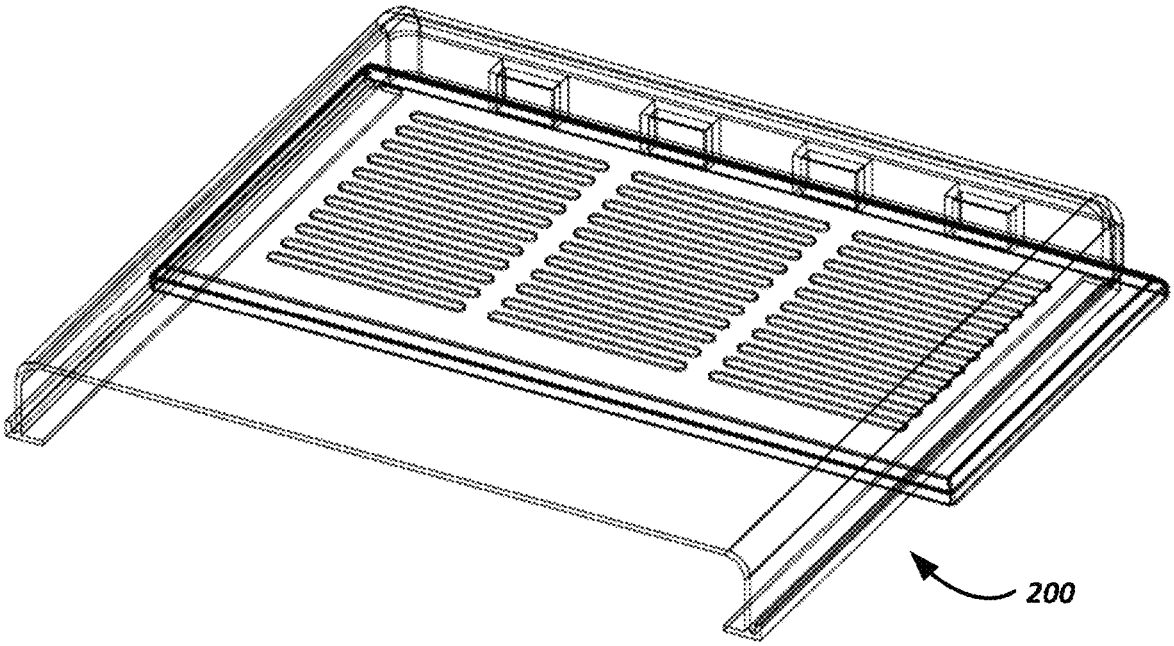
Figure 25:
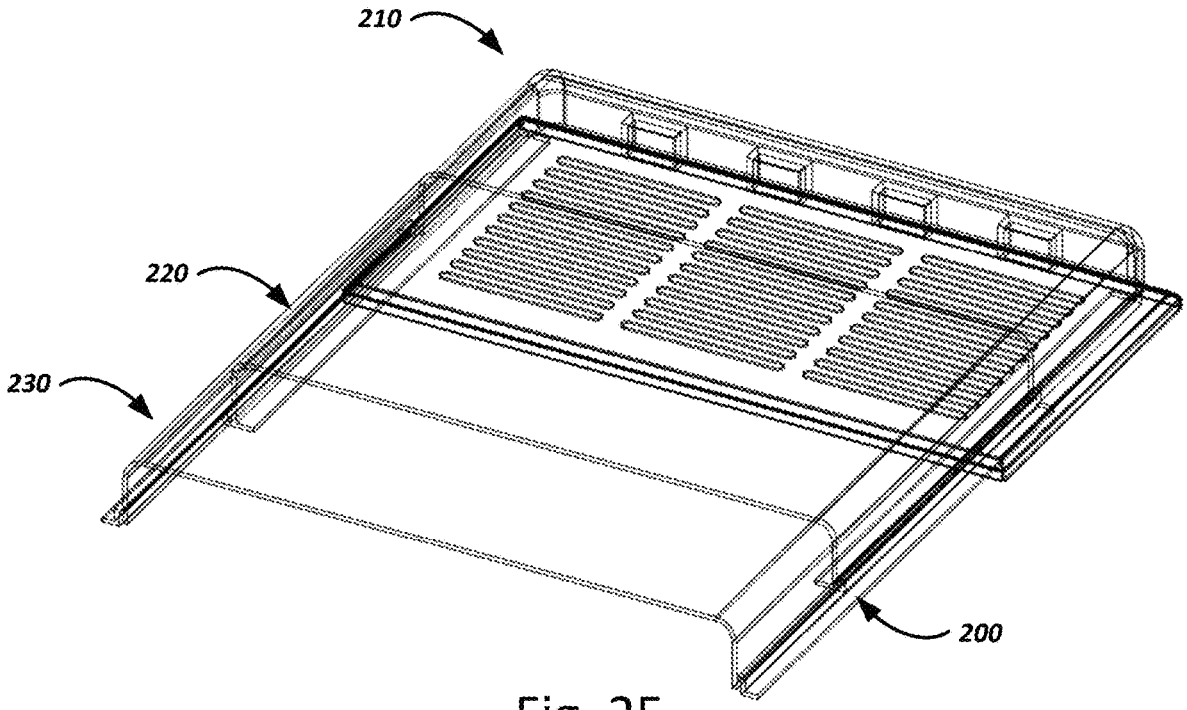

FIGS. 12-25 illustrate a second embodiment of an air deflector 200. Air deflector 200 may be formed of different portions, including a first portion 210 and an optional second portion 220 and an optional third portion 230. In some examples, first portion 210 may be used alone. Alternatively, second and/or third portions 220,230 may be added to extend the size of the deflector. First portion 210 and second portion 220 may be translatable relative to one another in the direction of arrow "B". First portion 210 may include two opposing sidewalls 212, a backwall 214 and an upper surface 216. Sidewalls 212 may include projections 213 that form channels 215 at the lower edges of each sidewall, the channels being sized to receive portions of the second and/or third portions 220,230. FIG. 18 shows a deflector 200 that utilizes only the first portion 210, and FIG. 19 shows a deflector 200 after second portion 220 has been added to first portion 210. In some examples, second portion 220 may include two opposing sidewalls 222, and an upper surface 226. Note that second portion 220 is formed as a bridge and includes no backwall. Moreover, sidewalls 222 may include lips 223 that are configured to be disposed within, and translate relative to, channels 215 of first portion 210 and a secondary channel 225 configured to receive a portion of third portion 230. FIG. 20 shows a deflector 200 after third portion 230 has been added to first and second portions 210,220. In some examples, third portion 230 may include two opposing sidewalls 232, and an upper surface 236. Note that third portion 230 is also formed as a bridge and includes no backwall. Moreover, sidewalls 232 may include lips 233 that are configured to be disposed within, and translate relative to, secondary channels 225 of second portions 220.

As shown in FIGS. 19-23, first portion 210, second portion 220 and third portion 230 may translate relative to one another so that upper surfaces overlap by a predetermined amount so to adjust the extend the size of the air deflector to accommodate various sizes (e.g., to extend the air deflector so that air can be passed under furniture). For example, in the smallest configuration, only the first portion 210 may be used. Alternatively, first and second portions 210,220 may be used together without third portion 230, and the two upper surfaces 216,226 may overlap by 20%, 30%, 40%, 50%, 60%, 70%, 80%, 90%, 95% or more. In some examples, vent deflector 200 may measure 16 inches in width, with an adjustable between 13 inches and 38 inches, fitting vents on ceilings, floors, and walls. They ensure effective air redirection for various vent sizes.

Air deflector 200 may further include a number of magnets to couple them to a magnetic air vent. Air deflector 200 is shown to include four magnets 250*a*-250*d* disposed within enclosures 251, but it will be understood that the number of magnets may vary. In the example shown, first portion 210 may include a four evenly spaced magnets 250*a*-250*d* adjacent backwall 214 along its bottom edge. In some examples, the magnets include neodymium magnets, ensuring a strong grip on walls and ceilings so that the vent deflector does not fall off the vent and provides peace of mind even with cleaning robots or accidental bumps. When air deflector 200 is to be utilized with a non-magnetic air vent, secondary magnets may be adhered (e.g., glued, etc.) onto the air vent at corresponding locations on the air vent so that magnets 250*a*-250*d* are attracted thereto to couple the air deflector to the air vent. Alternatively, double-sided stickers may couple the bottom of air deflector 200 to an air vent. Thus, the installation process requires no tools as the user may simply adjust the length of the air deflector to a particular size, and places it on the vent for coupling by magnets. For non-magnetic surfaces like wood or aluminum, stickers or secondary magnets may be used to aid in the coupling of the two components.

Figure 26A:
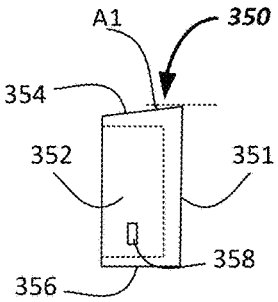
Figure 26B:
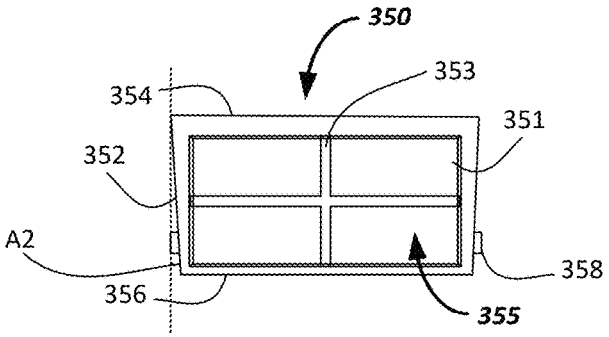
Figure 26C:
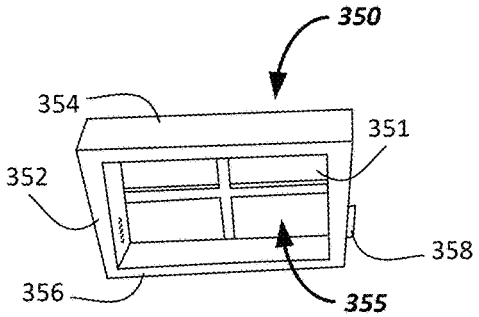
Figure 26D:
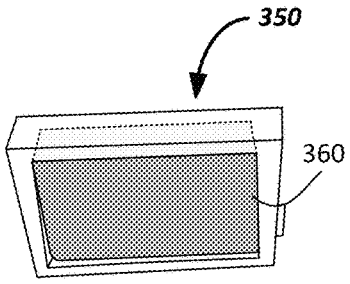
Figure 26E:
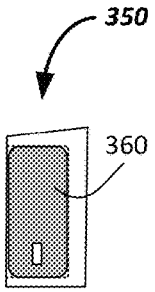
Figure 26F:
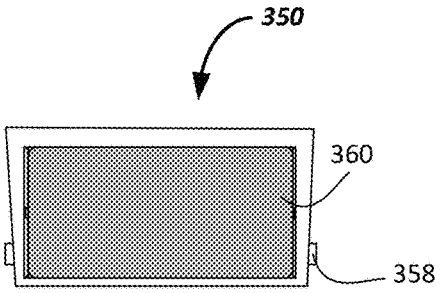

As previously noted, magnets 150,250 may be used to keep the air deflector coupled to an air vent, and these magnets may be disposed within enclosures. FIGS. 26A-27D illustrate one such example of coupling the magnets to the air deflectors. It will be understood that that configuration of the enclosures and/or magnets may be used with any of the air deflector configurations described herein. FIG. 26A-26C illustrates a separable holder 350 that forms a first portion of an enclosure. Holder 350 may generally include an outer wall 351, two sidewalls 352, a top wall 354 and a bottom wall 356. Holder 350 may be missing an inner wall opposite outer wall 351 so that a rectangular prism-shaped cavity 355 is defined by two sidewalls 352, top wall 354 and bottom wall 356, the cavity being sized and shaped to receive a similarly-shaped magnet (e.g., a magnet in the shape of a rectangular prism). Outer wall 351 may optionally include a cross-shaped support feature formed of two perpendicular beams to provide strength and rigidity to outer wall 351. In the example shown, top wall 354 may be sloped so that top wall 354 is thickest adjacent outer wall 351 and thinnest farthest away from outer wall 351. In some examples, top wall 354 may be angled by an angle A1 of between 0 and 45 degrees (e.g., between 0 and 15 degrees). Additionally, sidewalls 352 may be likewise sloped so that the they are thickest adjacent top wall 354 and thinnest adjacent bottom wall 356. In some examples, sidewalls 352 may angled by an angle A2 of between 0 and 45 degrees (e.g., between 0 and 15 degrees). Two tabs 358 may be disposed on sidewalls 352. In some examples, tabs 358 may be disposed closer to bottom wall 356 than top wall 353, and being disposed halfway between edges of sidewalls 352. FIGS. 26D-26F illustrates the same holder 350 with a rectangular prism-shaped magnet 360 disposed within cavity 355.

Figure 27A:
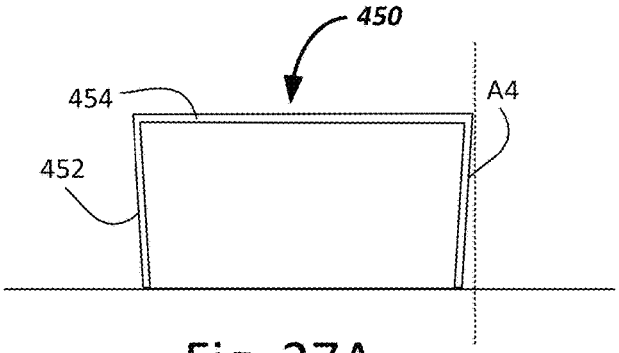
Figure 27B:
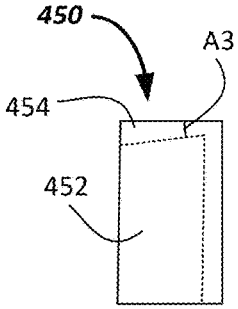
Figure 27C:
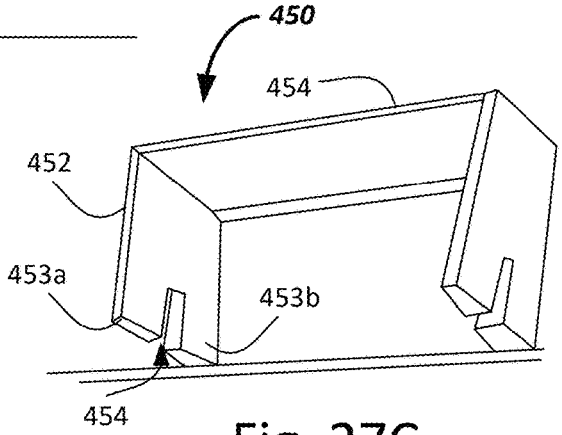
Figure 27D:
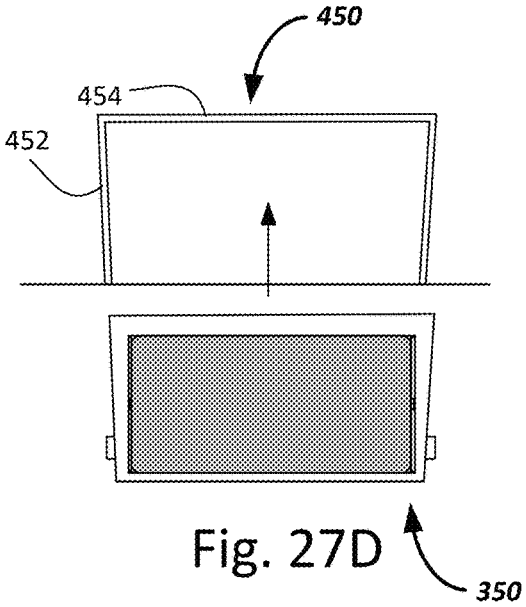
Figure 27E:
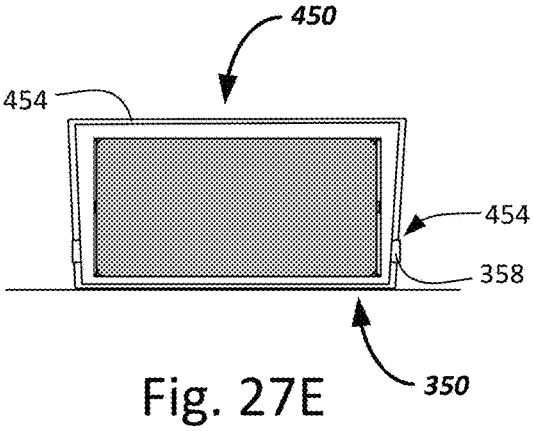

FIGS. 27A-27C illustrate a receptacle 450 configured to receive holder 350 (and with it, magnet 360). Receptacle 450 may include a pair of sidewalls 452 and a top wall 454. Receptacle 450 may be unitarily or integrally formed with a supporting portion of an air duct (e.g., with sidewalls 112,122 of air duct 100, or backwall 214 of air duct 200). The interior of top wall 454 may be slanted or sloped at an angle A3 corresponding to, or equal to, angle A1 of holder 350, and the interior of sidewalls 452 may be slanted or sloped at an angle A4 corresponding to, or equal to angle A2 of holder 350. In some examples, sidewalls 452 may be thickest closest to the supporting portion and thinnest farthest from the supporting portion. Optionally, each of sidewalls 452 may have a notch 454 at the bottom, the notch 454 being sized and shaped to receive one of the tabs 358 of holder 350. FIGS. 27D-27E illustrate receptacle 450 accepting holder 350. When properly secured within receptacle 450, holder 350 will securely retain a magnet therein. Specifically, slanted sidewalls 352 of holder 350 will be held in position by slanted sidewalls 452 or receptacle 450. Likewise, slanted top wall 454 will hold top wall 354 in place while notches 454 secure tabs 358 of the holder. It will be appreciated that portions of receptacle (e.g., sidewalls 452) may gently flex to allow the holder 350 to be secured within receptacle 450 via a friction-fit engagement. Moreover, magnet 360 will be entirely covered within the enclosure as it is surrounded by top wall 354, bottom wall 356, sidewalls 352 and outer wall 351 of holder 350 on five sides, and by a supporting portion of the air duct (e.g., with sidewalls 112,122 of air duct 100, or backwall 214 of air duct 200) on the sixth side.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. An adjustable air deflector comprising:

a first portion having a first sidewall and a first curved backwall;

a second portion having a second sidewall and a second curved backwall; and at least one enclosure configured to receive a magnet, the at least one enclosure including (i) a receptacle integrated with one of the first portion and the second portion, the receptacle including a pair of receptacle sidewalls and a receptacle top wall that couples to uppermost ends of the pair of receptacle sidewalls to create a continuous three-sided shape and (ii) a holder configured to fit within the receptacle, the holder including an outer wall, two sidewalls, a top wall, and a bottom wall, the sidewalls, top wall, and bottom wall of the holder collectively defining a cavity shaped to receive the magnet;

wherein the first portion and second portion are telescopically translatable relative to one another to vary a length of the air deflector, and a first one of the first portion and the second portion includes at least one projection defining at least one channel sized to receive at least one lip of a second one of the first portion and the second portion; and wherein the first portion and second portion are configured to translate between a first configuration in which the first and second curved backwalls overlap by at least 80% and a second configuration in which the first and second curved backwalls overlap by as little as 5%;

wherein each of the pair of receptacle sidewalls is slanted so that uppermost ends of the pair of receptacle sidewalls are farther from one another than lowermost ends of the pair of receptacle sidewalls.

2. The air deflector of claim 1, further comprising a tab disposed on each of the two sidewalls of the holder.

3. The air deflector of claim 1, wherein at least one of the holder two sidewalls and top wall is slanted.

4. The air deflector of claim 1, wherein each of the first curved backwall and the second curved backwall comprises a curved surface that defines a transition from a back surface to an upper surface, and wherein the first portion and second portion are coupled by frictional engagement between the at least one lip and the at least one channel.

5. The air deflector of claim 1, wherein the first portion includes the at least one projection defining the at least one channel, and the second portion includes at the least one lip configured to fit within the at least one channel.

6. The air deflector of claim 1, wherein the first portion includes two projections defining two channels disposed along a top edge and a bottom edge of the first curved backwall, and the second portion includes two lips disposed along a top edge and a bottom edge of the second curved backwall and being configured to fit within the two channels.

7. The air deflector of claim 1, wherein the second portion includes the at least one projection defining the at least one channel, and the first portion includes the at least one lip configured to fit within the at least one channel.

8. An adjustable air deflector comprising:

a first portion having a first sidewall and a first curved backwall;

a second portion having a second sidewall and a second curved backwall; and at least one enclosure configured to receive a magnet, the at least one enclosure including a receptacle integrated with one of the first portion and the second portion, and a holder configured to fit within the receptacle, the holder including an outer wall, two sidewalls, a top wall, and a bottom wall, the sidewalls, top wall, and bottom wall of the holder collectively defining a cavity shaped to receive the magnet;

wherein the first portion and second portion are telescopically translatable relative to one another to vary a length of the air deflector, and a first one of the first portion and the second portion includes at least one projection defining at least one channel sized to receive at least one lip of a second one of the first portion and the second portion; and wherein the first portion and second portion are configured to translate between a first configuration in which the first and second curved backwalls overlap by at least 80% and a second configuration in which the first and second curved backwalls overlap by as little as 5%, wherein the at least one enclosure comprises three enclosures on the first portion and two enclosures on the second portion.

9. An enclosure for an air redirecting device, comprising:

a receptacle integrated with a portion of the air redirecting device, the receptacle including a pair of receptacle sidewalls and a receptacle top wall that couples to uppermost ends of the pair of receptacle sidewalls to create a continuous three-sided shape; and a holder configured to fit within the receptacle, the holder including an outer wall, two sidewalls, a top wall, and a bottom wall, the sidewalls, top wall, and bottom wall of the holder collectively defining a cavity shaped to receive a magnet;

wherein each of the pair of receptacle sidewalls is slanted so that uppermost ends of the pair of receptacle sidewalls are farther from one another than lowermost ends of the pair of receptacle sidewalls.

* * * * *